US011564457B1

(12) United States Patent
Wu

(10) Patent No.: US 11,564,457 B1
(45) Date of Patent: Jan. 31, 2023

(54) SAFETY BELT BUCKLE ASSEMBLY

(71) Applicant: TAIWAN RACING PRODUCTS CO., LTD., Changhua Hsien (TW)

(72) Inventor: Wen-Yuan Wu, Changhua Hsien (TW)

(73) Assignee: TAIWAN RACING PRODUCTS CO., LTD., Changhua Hsien (TW)

( * ) Notice: Subject to any disclaimer, the term of this patent is extended or adjusted under 35 U.S.C. 154(b) by 0 days.

(21) Appl. No.: 17/530,580

(22) Filed: Nov. 19, 2021

(51) Int. Cl.
*A44B 11/25* (2006.01)

(52) U.S. Cl.
CPC ..... *A44B 11/2546* (2013.01); *A44B 11/2526* (2013.01); *Y10T 24/45639* (2015.01); *Y10T 24/45675* (2015.01); *Y10T 24/45686* (2015.01)

(58) Field of Classification Search
CPC ..... A44B 11/2546; A44B 11/2526; Y10T 24/45639; Y10T 24/45675; Y10T 24/45686
See application file for complete search history.

(56) References Cited

U.S. PATENT DOCUMENTS 8,042,235 B2 * 10/2011 Wu ..... A44B 11/2526 24/641
10,477,926 B1 * 11/2019 Wu ..... A44B 11/006

* cited by examiner

*Primary Examiner* — Robert Sandy
(74) *Attorney, Agent, or Firm* — Alan D. Kamrath; Karin L. Williams; Mayer & Williams PC

(57) ABSTRACT

A safety belt buckle assembly includes a base, two combination pieces, and a locking member. The base has a mounting section, a belt passage section, a receiving slot, a connecting portion, and an insertion opening. The combination pieces are located at two sides of the receiving slot. Each of the combination pieces has a shaft receiving groove and an insertion hole. A shaft is mounted in the shaft receiving groove of each of the combination pieces and extends through a shaft hole of the locking member. Each of the combination pieces is provided with a resting member, an elastic member, and a covering member mounted in the insertion hole respectively. The locking member is pivotally mounted on the base and has a locking portion locked by the resting member of each of the combination pieces.

10 Claims, 5 Drawing Sheets

SAFETY BELT BUCKLE ASSEMBLY

BACKGROUND OF THE INVENTION

1. Field of the Invention

The present invention relates to a safety belt buckle and, more particularly, to a safety belt buckle assembly for a safety belt of a race car.

2. Description of the Related Art

A conventional safety belt latch for a race car in accordance with the prior art shown in FIG. 5 comprises a buckle unit 5 and a latch plate unit 6. The buckle unit 5 includes a base 51, a first adjusting lever 52, a locking member 53, and a retaining mechanism 54. The base 51 is formed by a forged metal. The base 51 is provided with a first elongate slot 511, two sidewalls 512, and a frame 513. The first adjusting lever 52 is movably mounted between the two sidewalls 512 of the base 51. One side of a safety belt extends through the first elongate slot 511 of the base 51 and the first adjusting lever 52. The locking member 53 is pivotally mounted on the base 51. The locking member 53 is provided with a driving handle 531, a hooked portion 532, and a locking groove 533. The retaining mechanism 54 is mounted on the base 51 and includes a ball, a spring, and a cap. The latch plate unit 6 includes a sheet plate 61 and a second adjusting lever 62. The sheet plate 61 is provided with a second elongate slot 611, two sidewalls 612, and a hooked hole 63. The second adjusting lever 62 is movably mounted between the two sidewalls 612 of the sheet plate 61. The other side of a safety belt extends through the second elongate slot 611 of the sheet plate 61 and the second adjusting lever 62.

In practice, the locking member 53 is pivoted through a determined angle. Then, the sheet plate 61 is inserted into the frame 513. Then, the locking member 53 is pivoted reversely so that the hooked portion 532 is hooked on the hooked hole 63. At this time, the locking groove 533 is locked by the retaining mechanism 54. Thus, the sheet plate 61 is secured to the base 51 by the locking member 53. When the user wishes to release the safety belt, the locking member 53 is pivoted to detach the locking groove 533 from the retaining mechanism 54. Then, the locking member 53 is further pivoted through a determined angle to detach the hooked portion 532 from the hooked hole 63 so that the sheet plate 61 can be detached from the frame 513 to detach the latch plate unit 6 from the buckle unit 5 so as to release the safety belt.

However, the safety belt buckle needs to be forged into shape during the working process. Then, a drilling process is performed to drill holes in the safety belt buckle. Then, the parts are assembled to construct the buckle unit 5. Thus, fabrication of the conventional safety belt latch is complicated. In addition, it is necessary to check whether the forging material has cracks in the working process, but many small cracks are difficult to be perceived. Thus, it is necessary to pay attention to the various conditions in the forging process to ensure that the cracks are reduced after the product is formed. Besides, the forging process will cause an oxidation effect, so that oxides are easily formed on the surface of the finished product, resulting in different sizes of the finished product. Further, after the hole is drilled, the thickness at the periphery of the drilled hole is different due to oxidation effect, thereby decreasing the overall mechanical strength. Therefore, it is necessary to increase the thickness during the forging process to stabilize the whole strength, so that the forging process for making the safety belt buckle has complicated procedures in production, and the finished product has a poor quality during the subsequent working process, resulting in waste of resources. Further, the product produced by the forging process consumes much time, thereby increasing the cost of fabrication.

BRIEF SUMMARY OF THE INVENTION

The primary objective of the present invention is to provide a safety belt buckle assembly having a reinforced and stabilized structure to enhance the safety of use.

In accordance with the present invention, there is provided a safety belt buckle assembly comprising a base, two combination pieces, and a locking member. The base has a front end provided with a mounting section and a rear end provided with a belt passage section. The mounting section of the base has a middle provided with a receiving slot. The mounting section of the base has a front end provided with a connecting portion. The receiving slot of the base is connected to the connecting portion of the mounting section. The connecting portion of the base is bent and formed with an insertion opening. The two combination pieces are located at two sides of the receiving slot of the base. Each of the two combination pieces is provided with at least one fitting portion connected to the mounting section of the base. Each of the two combination pieces has a first end recessed with a shaft receiving groove covering the mounting section of the base. A shaft is mounted in the shaft receiving groove of each of the two combination pieces. Each of the two combination pieces has a second end formed with an insertion hole. The insertion holes of the two combination pieces are arranged in the mounting section of the base symmetrically. The insertion hole of each of the two combination pieces has a first end provided with a first opening distant from the receiving slot of the base and a second end provided with a second opening directed toward the receiving slot of the base. The insertion hole of each of the two combination pieces has a diameter reduced gradually from the first opening toward the second opening. Each of the two combination pieces is provided with a resting member, an elastic member, and a covering member mounted in the insertion hole respectively. The elastic member of each of the two combination pieces is biased between the resting member and the covering member. The resting member of each of the two combination pieces is retained in the second opening of the insertion hole. The resting members of the two combination pieces are pushed toward each other by the elastic members respectively. The covering member of each of the two combination pieces is secured in the first opening of the insertion hole. The locking member is pivotally mounted on the mounting section of the base and received in the receiving slot of the base. The locking member is provided with a shaft hole, and the shaft extends through the shaft hole of the locking member. The locking member has a first end provided with a hooked portion and a second end provided with a driving portion. The hooked portion and the driving portion of the locking member are directed in two opposite directions. The locking member is provided with a locking portion locked by the resting member of each of the two combination pieces.

According to the primary advantage of the present invention, the safety belt buckle assembly is assembled and constructed to reach a steady structure by a better installation way so that the safety belt buckle assembly is worked easily and conveniently and enhances the safety of use and operation.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
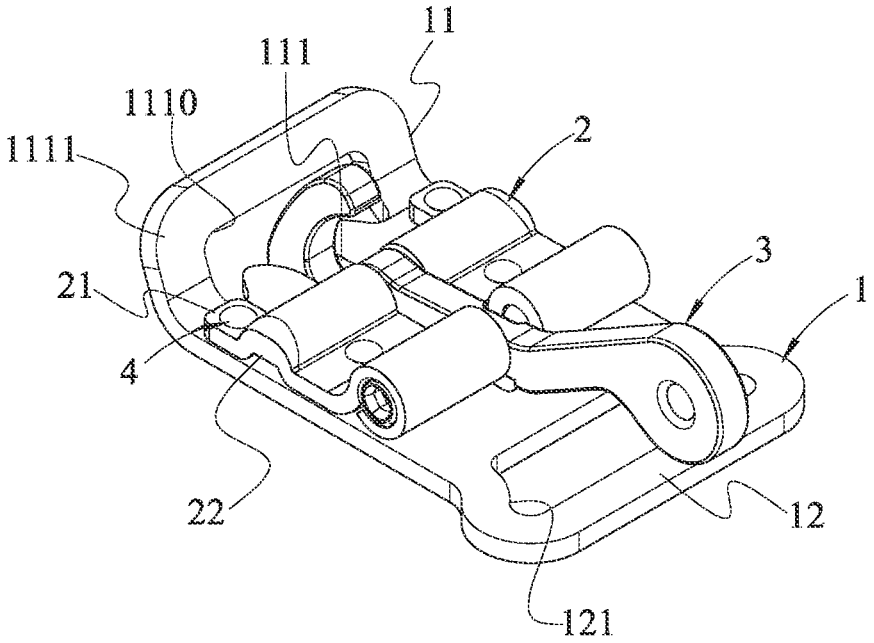
FIG. 1 is a perspective view of a safety belt buckle assembly in accordance with the preferred embodiment of the present invention.
Figure 2:
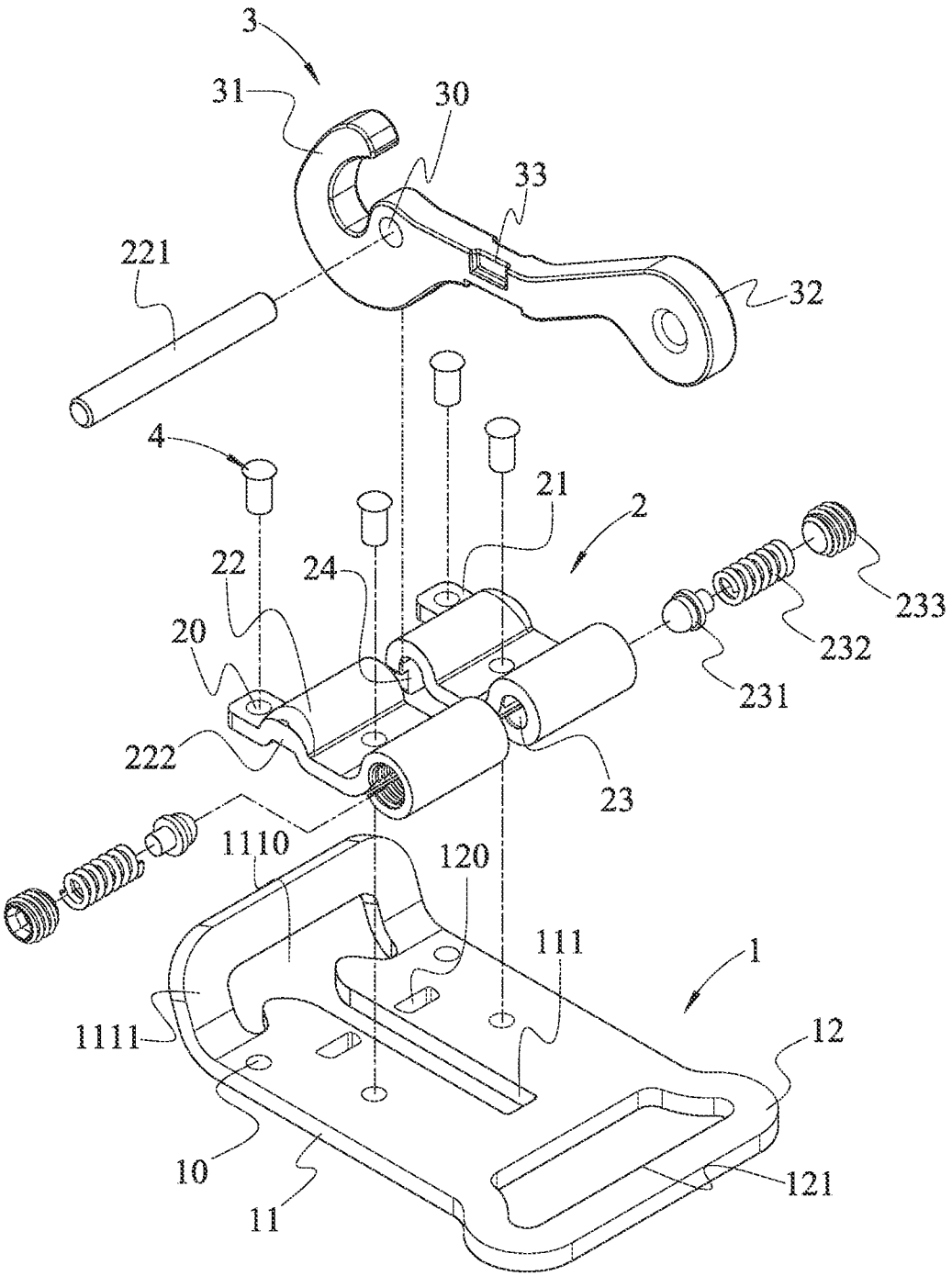
FIG. 2 is an exploded perspective view of the safety belt buckle assembly as shown in FIG. 1.
Figure 3:
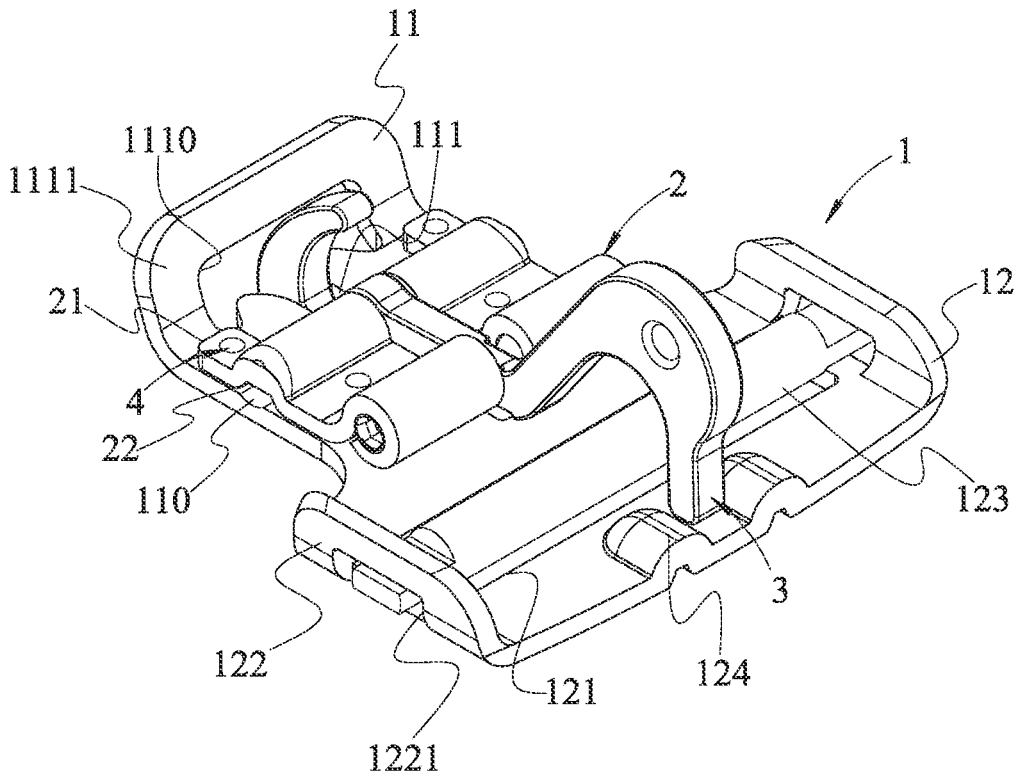
FIG. 3 is a perspective view of a safety belt buckle assembly in accordance with another preferred embodiment of the present invention.
Figure 4:
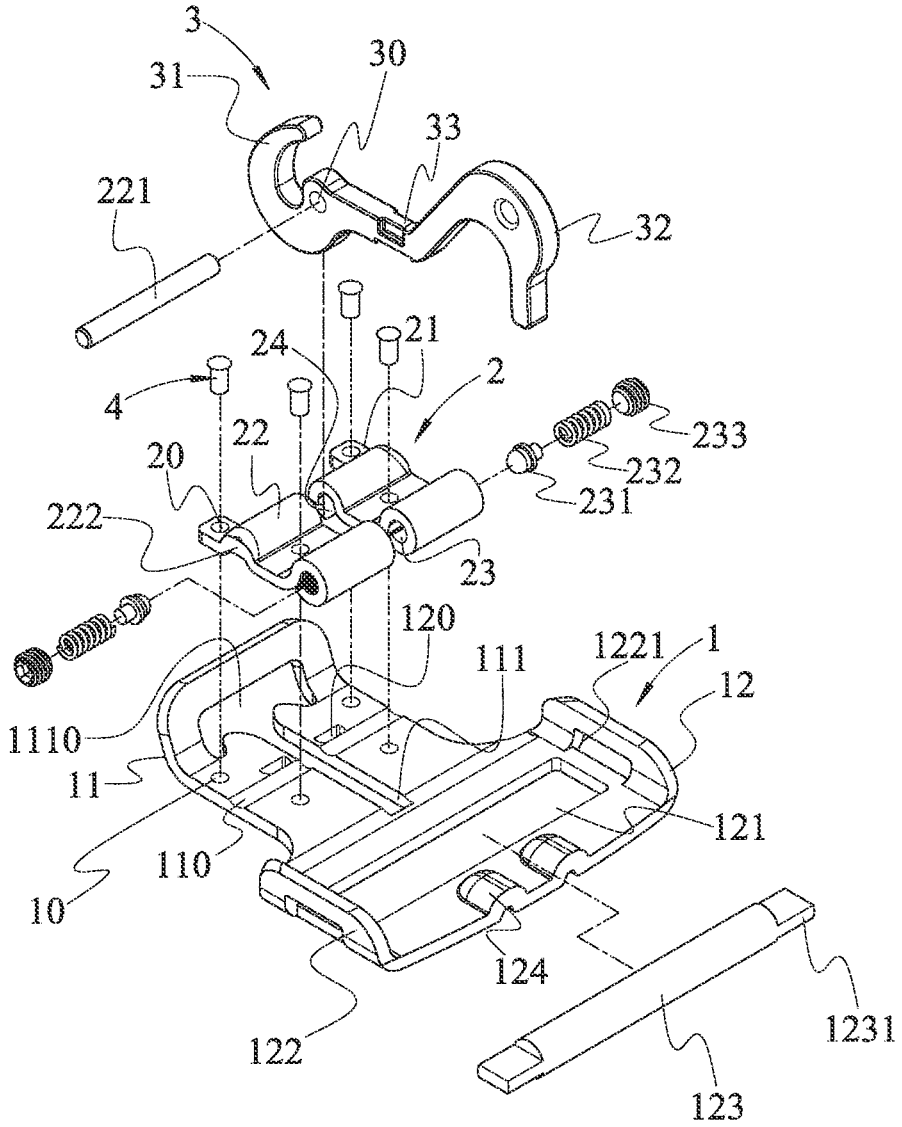
FIG. 4 is an exploded perspective view of the safety belt buckle assembly as shown in FIG. 3.
Figure 5:
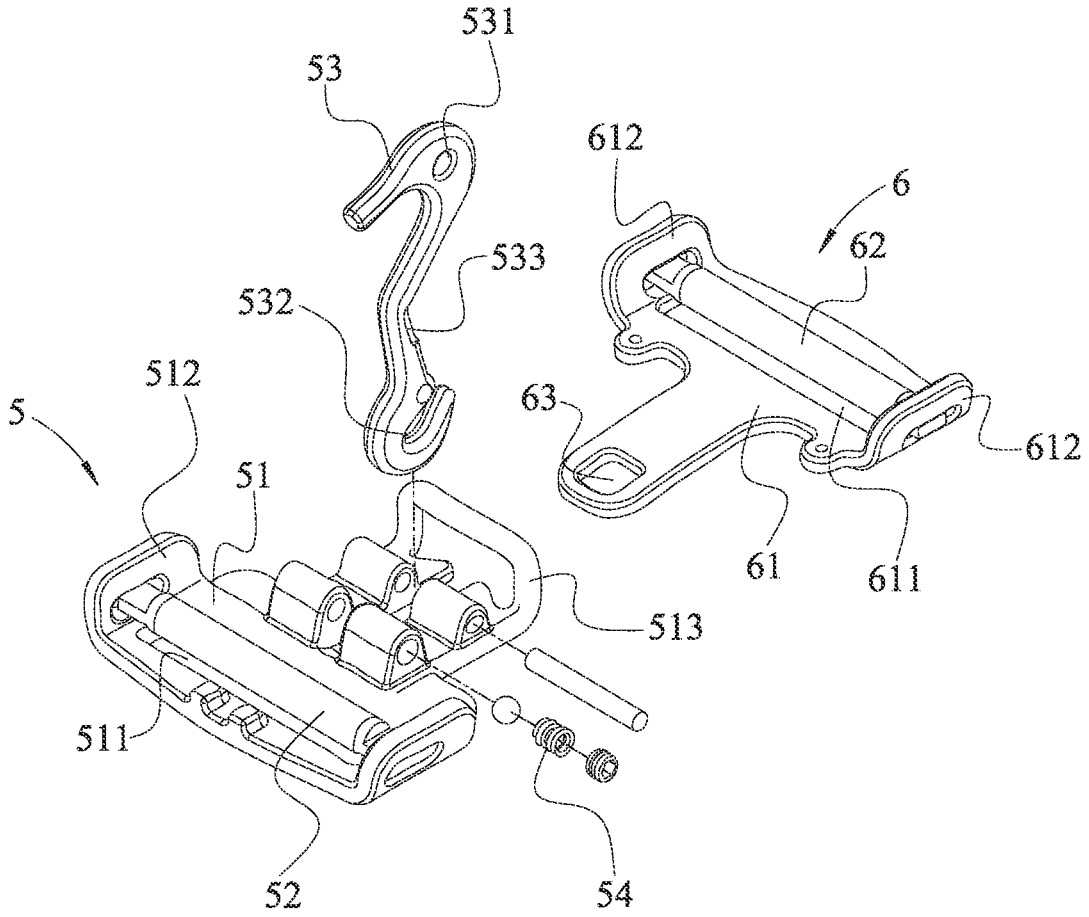
F I G . 5 PRIOR ART
FIG. 5 is an exploded perspective view of a conventional safety belt latch in accordance with the prior art.

Referring to FIGS. 1-4, a safety belt buckle assembly in accordance with the preferred embodiment of the present invention comprises a base 1, two combination pieces 2, and a locking member 3.

The base 1 has a front end provided with a mounting section 11 and a rear end provided with a belt passage section 12. The mounting section 11 of the base 1 is used for mounting a latch plate (not shown) of a safety belt (not shown). The belt passage section 12 of the base 1 is used for mounting a belt body of the safety belt. The mounting section 11 of the base 1 has a middle provided with a receiving slot 111. The mounting section 11 of the base 1 has a front end provided with a connecting portion 1111. The receiving slot 111 of the base 1 is connected to the connecting portion 1111 of the mounting section 11. The connecting portion 1111 of the base 1 is bent upward and formed with an insertion opening 1110 allowing insertion of the latch plate of the safety belt. The insertion opening 1110 is connected to the receiving slot 111.

The two combination pieces 2 are located at two sides of the receiving slot 111 of the base 1, with the receiving slot 111 of the base 1 being arranged between the two combination pieces 2. Each of the two combination pieces 2 is provided with at least one fitting portion 21 connected to the mounting section 11 of the base 1. Each of the two combination pieces 2 has a first end recessed with a shaft receiving groove 22 covering the mounting section 11 of the base 1. The shaft receiving groove 22 of each of the two combination pieces 2 has a hole shape. A shaft 221 is mounted in the shaft receiving groove 22 of each of the two combination pieces 2. Each of the two combination pieces 2 has a second end rolled and formed with an insertion hole 23. The insertion holes 23 of the two combination pieces 2 are arranged in the mounting section 11 of the base 1 symmetrically. The insertion hole 23 of each of the two combination pieces 2 has a first end provided with a first opening distant from the receiving slot 111 of the base 1 and a second end provided with a second opening directed toward the receiving slot 111 of the base 1. The insertion hole 23 of each of the two combination pieces 2 has a diameter reduced gradually from the first opening toward the second opening. Thus, the insertion hole 23 of each of the two combination pieces 2 has a tapered shape with a reduced diameter. Each of the two combination pieces 2 is provided with a resting member 231, an elastic member 232, and a covering member 233 mounted in the insertion hole 23 respectively. The elastic member 232 of each of the two combination pieces 2 is biased between the resting member 231 and the covering member 233. The resting member 231 of each of the two combination pieces 2 is retained in the second opening of the insertion hole 23 and partially protrudes from the insertion hole 23. The second opening of the insertion hole 23 has a reduced diameter to prevent the resting member 231 of each of the two combination pieces 2 from being detached from the insertion hole 23. The resting members 231 of the two combination pieces 2 are pushed toward each other by the elastic members 232 respectively. The covering member 233 of each of the two combination pieces 2 is secured in the first opening of the insertion hole 23.

The locking member 3 is pivotally mounted on the mounting section 11 of the base 1 and received in the receiving slot 111 of the base 1. The locking member 3 is provided with a shaft hole 30, and the shaft 221 extends through the shaft hole 30 of the locking member 3. Thus, the locking member 3 is pivoted about the shaft 221 and is pivotable in the receiving slot 111 of the base 1. The locking member 3 is arranged between the two combination pieces 2. The locking member 3 has a first end provided with a hooked portion 31 and a second end provided with a driving portion 32. The hooked portion 31 and the driving portion 32 of the locking member 3 are directed in two opposite directions. The driving portion 32 of the locking member 3 has a hooked shape. When the locking member 3 is disposed at a hooked state, the driving portion 32 of the locking member 3 rests on the top of the belt passage section 12 of the base 1. The locking member 3 is provided with a locking portion 33 locked by the resting member 231 of each of the two combination pieces 2.

In practice, the latch plate of the safety belt is inserted into the insertion opening 1110 of the base 1, and when the locking member 3 is pivoted, the hooked portion 31 of the locking member 3 is locked in a locking hole (not shown) formed in the latch plate so that the latch plate is secured to the base 1 by the locking member 3.

In the preferred embodiment of the present invention, the base 1 and each of the two combination pieces 2 are formed by stamping.

In the preferred embodiment of the present invention, the base 1 is provided with at least one first through hole 10, each of the two combination pieces 2 is provided with at least one second through hole 20, and the safety belt buckle assembly further comprises at least one fastening member 4 extending through the at least one second through hole 20 of each of the two combination pieces 2 and the at least one first through hole 10 of the base 1, so that each of the two combination pieces 2 is affixed to the base 1. Preferably, the at least one second through hole 20 of each of the two combination pieces 2 is formed in the at least one fitting portion 21. Preferably, the at least one fastening member 4 is a screw or a rivet so that each of the two combination pieces 2 is assembled with the base 1 easily and quickly.

In the preferred embodiment of the present invention, each of the two combination pieces 2 is provided with a stop portion 222 covering an outer edge of the shaft receiving groove 22 and resting on the shaft 221 to prevent the shaft 221 from being detached from the shaft receiving groove 22.

In the preferred embodiment of the present invention, the locking portion 33 of the locking member 3 has a stepped shape. Preferably, the locking portion 33 of the locking member 3 has two sides each formed with a cavity for receiving the resting member 231 of each of the two combination pieces 2.

In the preferred embodiment of the present invention, the base 1 is provided with two resting holes 120, and each of the two combination pieces 2 is provided with a resting protrusion 24 directed downward and inserted into one of the two resting holes 120 of the base 1. Preferably, the two resting holes 120 of the base 1 are formed in the belt passage section 12.

Thus, the resting protrusion 24 of each of the two combination pieces 2 aligns with one of the two resting holes 120 of the base 1 during the assembling process, so that the two combination pieces 2 are mounted on the base 1 easily and conveniently. In addition, when the two combination pieces 2 are subjected to an external force, the resting protrusion 24 of each of the two combination pieces 2 is secured in one of the two resting holes 120 of the base 1 to share and evenly distribute the external force applied on the at least one fastening member 4, so that the two combination pieces 2 are able to withstand a larger force so as to enhance the safety of use.

In the preferred embodiment of the present invention, the belt passage section 12 of the base 1 is provided with a mounting opening 121. The belt passage section 12 of the base 1 has two sidewalls 122. Each of the two sidewalls 122 of the belt passage section 12 is bent upward and formed with a passage 1221. The passages 1221 of the two sidewalls 122 of the belt passage section 12 are opposite to each other.

In the preferred embodiment of the present invention, the safety belt buckle assembly further comprises an adjusting lever 123 extending through the passage 1221 of each of the two sidewalls 122 of the belt passage section 12. The adjusting lever 123 has two ends each provided with an insert 1231 inserted into the passage 1221 of one of the two sidewalls 122 of the belt passage section 12.

Thus, the safety belt passes through the adjusting lever 123 and the mounting opening 121. The length of the safety belt is adjusted by the adjusting lever 123.

In the preferred embodiment of the present invention, the insertion hole 23 of each of the two combination pieces 2 is provided with an internal thread, and the covering member 233 of each of the two combination pieces 2 is provided with an external thread screwed into the internal thread of the insertion hole 23 to secure the covering member 233 of each of the two combination pieces 2 into the insertion hole 23.

In the preferred embodiment of the present invention, the mounting section 11 of the base 1 is provided with two transverse shaft channels 110 traversing the receiving slot 111. Preferably, the two shaft channels 110 of the base 1 are formed by stamping during the working process. Each of the two shaft channels 110 of the base 1 aligns with the shaft receiving groove 22 of one of the two combination pieces 2, and aligns with the insertion hole 23 of one of the two combination pieces 2. The shaft 221 is mounted in the two shaft channels 110 of the base 1. Thus, the shaft 221 is clamped between the two shaft channels 110 of the base 1 and the shaft receiving groove 22 of each of the two combination pieces 2.

Thus, the shaft 221 is mounted between the base 1 and the two combination pieces 2 easily and quickly by alignment of the two shaft channels 110 of the base 1 with the shaft receiving grooves 22 of the two combination pieces 2. In addition, when the safety belt is pulled due to an impact, the hooked portion 31 of the locking member 3 is drawn by the latch plate of the safety belt, and the shaft 221 is also pulled by the locking member 3. At this time, each of the two shaft channels 110 of the base 1 and the shaft receiving groove 22 of each of the two combination pieces 2 provide a larger lateral contact area with the shaft 221 to evenly and steadily distribute the pulling force applied on the shaft 221, so as to enhance the structural strength of the safety belt buckle assembly.

In the preferred embodiment of the present invention, the belt passage section 12 of the base 1 has a rear end provided with two clamping portions 124. The two clamping portions 124 of the base 1 are located at two sides of the driving portion 32 of the locking member 3 when the driving portion 32 of the locking member 3 rests on the belt passage section 12 of the base 1. Thus, when the driving portion 32 of the locking member 3 is located at the belt passage section 12 of the base 1, the driving portion 32 of the locking member 3 is clamped between the two clamping portions 124 of the base 1.

It is appreciated that, when the latch plate of the safety belt is hooked by the hooked portion 31 of the locking member 3, the driving portion 32 of the locking member 3 rests on the belt passage section 12 of the base 1 and presses the safety belt that is wound around the belt passage section 12 of the base 1. In such a manner, the driving portion 32 of the locking member 3 is located above the safety belt, and the two clamping portions 124 of the base 1 are located under the safety belt, so that the driving portion 32 of the locking member 3 and the two clamping portions 124 of the base 1 press the safety belt from top to bottom in an alternating manner Thus, when the user is subjected to an impact and presses the rear end of the base 1, the bottom of the hooked portion 31 of the locking member 3 is pushed, to increase a force that pushes the driving portion 32 of the locking member 3, so that the driving portion 32 of the locking member 3 and the two clamping portions 124 of the base 1 apply an force mutually to prevent the safety belt from slipping freely.

Accordingly, the safety belt buckle assembly is assembled and constructed to reach a steady structure by a better installation way so that the safety belt buckle assembly is worked easily and conveniently and enhances the safety of use and operation.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A safety belt buckle assembly comprising:

a base, two combination pieces, and a locking member;

wherein:

the base has a front end provided with a mounting section and a rear end provided with a belt passage section;

the mounting section of the base has a middle provided with a receiving slot;

the mounting section of the base has a front end provided with a connecting portion;

the receiving slot of the base is connected to the connecting portion of the mounting section;

the connecting portion of the base is bent and formed with an insertion opening;

the two combination pieces are located at two sides of the receiving slot of the base;

each of the two combination pieces is provided with at least one fitting portion connected to the mounting section of the base;

each of the two combination pieces has a first end recessed with a shaft receiving groove covering the mounting section of the base;

a shaft is mounted in the shaft receiving groove of each of the two combination pieces;

each of the two combination pieces has a second end formed with an insertion hole;

the insertion holes of the two combination pieces are arranged in the mounting section of the base symmetrically;

the insertion hole of each of the two combination pieces has a first end provided with a first opening distant from the receiving slot of the base and a second end provided with a second opening directed toward the receiving slot of the base;

the insertion hole of each of the two combination pieces has a diameter reduced gradually from the first opening toward the second opening;

each of the two combination pieces is provided with a resting member, an elastic member, and a covering member mounted in the insertion hole respectively;

the elastic member of each of the two combination pieces is biased between the resting member and the covering member;

the resting member of each of the two combination pieces is retained in the second opening of the insertion hole;

the resting members of the two combination pieces are pushed toward each other by the elastic members respectively;

the covering member of each of the two combination pieces is secured in the first opening of the insertion hole;

the locking member is pivotally mounted on the mounting section of the base and received in the receiving slot of the base;

the locking member is provided with a shaft hole, and the shaft extends through the shaft hole of the locking member;

the locking member has a first end provided with a hooked portion and a second end provided with a driving portion;

the hooked portion and the driving portion of the locking member are directed in two opposite directions; and the locking member is provided with a locking portion locked by the resting member of each of the two combination pieces.

2. The safety belt buckle assembly as claimed in claim 1, wherein the base is provided with at least one first through hole, each of the two combination pieces is provided with at least one second through hole, and the safety belt buckle assembly further comprises at least one fastening member extending through the at least one second through hole of each of the two combination pieces and the at least one first through hole of the base.

3. The safety belt buckle assembly as claimed in claim 1, wherein each of the two combination pieces is provided with a stop portion covering an outer edge of the shaft receiving groove and resting on the shaft.

4. The safety belt buckle assembly as claimed in claim 1, wherein the locking portion of the locking member has a stepped shape.

5. The safety belt buckle assembly as claimed in claim 1, wherein the base is provided with two resting holes, and each of the two combination pieces is provided with a resting protrusion directed downward and inserted into one of the two resting holes of the base.

6. The safety belt buckle assembly as claimed in claim 1, wherein:

the belt passage section of the base is provided with a mounting opening;

the belt passage section of the base has two sidewalls;

each of the two sidewalls of the belt passage section is bent and formed with a passage; and the passages of the two sidewalls of the belt passage section are opposite to each other.

7. The safety belt buckle assembly as claimed in claim 6, further comprising:

an adjusting lever extending through the passage of each of the two sidewalls of the belt passage section;

wherein:

the adjusting lever has two ends each provided with an insert inserted into the passage of one of the two sidewalls of the belt passage section.

8. The safety belt buckle assembly as claimed in claim 1, wherein the insertion hole of each of the two combination pieces is provided with an internal thread, and the covering member of each of the two combination pieces is provided with an external thread screwed into the internal thread of the insertion hole.

9. The safety belt buckle assembly as claimed in claim 1, wherein:

the mounting section of the base is provided with two transverse shaft channels traversing the receiving slot;

each of the two shaft channels of the base aligns with the shaft receiving groove of one of the two combination pieces; and the shaft is mounted in the two shaft channels of the base.

10. The safety belt buckle assembly as claimed in claim 1, wherein:

the belt passage section of the base has a rear end provided with two clamping portions; and the two clamping portions of the base are located at two sides of the driving portion of the locking member when the driving portion of the locking member rests on the belt passage section of the base.

* * * * *